United States Patent [19]

Curwen

[11] Patent Number: 4,750,870

[45] Date of Patent: Jun. 14, 1988

[54] PRESSURE ACTUATED MOVABLE HEAD FOR A RESONANT RECIPROCATING COMPRESSOR BALANCE CHAMBER

[75] Inventor: Peter W. Curwen, Ballston Spa, N.Y.

[73] Assignee: Mechanical Technology Incorporated, Latham, N.Y.

[21] Appl. No.: 14,444

[22] Filed: Feb. 13, 1987

[51] Int. Cl.[4] ..... F04B 31/00

[52] U.S. Cl. ..... 417/416; 417/340; 92/133; 92/134

[58] Field of Search ..... 417/415, 416, 340, 11; 92/133, 134; 123/46 R

[56] References Cited

U.S. PATENT DOCUMENTS

| | | | |
|---|---|---|---|
| 2,461,225 | 2/1949 | Meitzler | 417/274 X |
| 2,761,615 | 9/1956 | Prince | 417/274 X |
| 2,853,982 | 9/1958 | Bachle et al. | 417/340 |
| 3,524,436 | 8/1970 | Braun | 123/46 R |
| 4,167,922 | 9/1979 | Doundoulakis | 123/46 R |
| 4,353,220 | 10/1982 | Curwen et al. | 417/416 X |
| 4,433,279 | 2/1984 | Bhate | 310/15 X |
| 4,488,853 | 12/1984 | Benson | 417/340 X |
| 4,576,011 | 3/1986 | Glamm et al. | 62/324.6 X |

FOREIGN PATENT DOCUMENTS

| | | |
|---|---|---|
| 0731037 | 4/1980 | U.S.S.R. . |

*Primary Examiner*—Leonard E. Smith
*Assistant Examiner*—Eugene L. Szczecina, Jr.
*Attorney, Agent, or Firm*—Joseph V. Claeys; Joseph C. Sullivan

[57] ABSTRACT

In a resonant piston compressor utilizing a balance chamber to provide a gas spring effect for use in a heat pump arrangement and the like, an adjustable balance cylinder head which adjusts so as to increase or decrease the balance chamber volume so as to increase or decrease the stiffness of the balance chamber, depending upon the mode of operation desired.

5 Claims, 6 Drawing Sheets

PRESSURE ACTUATED MOVABLE HEAD FOR A RESONANT RECIPROCATING COMPRESSOR BALANCE CHAMBER

TECHNICAL FIELD

The present invention relates to resonant reciprocating compressors and more particularly to arrangements for providing a pressure actuated movable head for the balance chamber of such compressors.

BACKGROUND ART

There exists a class of machinery which utilizes mechanical resonance as the means to obtain periodic motion of the machine's elements. For convenience the resonant machine of this invention will be referred to as a Resonant Piston Compressor (RPC). The RPC is a reciprocating compressor which falls into this class of machinery, and which can be utilized in various compressor applications, such as for example electrically-driven heat pumps. Generally an RPC is comprised of an electrodynamic motor which drives a reciprocating piston and thereby provides the compression action on a working fluid which may be a gas or a liquid.

In known free piston resonant reciprocating compressors the fluid compressing member, such as a piston, is driven by a suitable motor, such as a linear reciprocating electrodynamic motor. A compression piston is usually coupled to the motor armature and the armature held in a rest position by way of one or more main or resonance springs. When the motor is energized, such as by an alternating current, a magnetic force is generated to drive the piston and the resonance spring causes the piston to oscillate back and forth to provide compression of the fluid.

U.S. Pat. Nos. 3,937,600 to White for a "Controlled Electrodynamic Linear Compressor" and 4,353,220 to Curwen for a "Resonant Piston Compressor Having Improved Stroke Control for Lead-Following Electric Heat Pumps and the Like" relate to double-ended type, electrodynamic motor-driven reciprocating compressors including gas springs. In such double-ended two-compressor cylinder arrangements, identical parallel flow cylinders are involved. In principal, these two cylinders would undergo the same compression cycle and would be subjected to the same pressure forces so that such double-ended design would (in theory) be intrinsically pressure balanced. In practicality, however, such designs are inherently unstable. As long as the two cylinders operate with the same value of mid-stroke volume (or equivalently, at the same clearance volume ratio) then the two cylinders will impose equal but oppositely-directed (cancelling) average pressure forces on the plunger-driven pistons. However, any slight offset bias of the plunger from the theoretical center position causes the average pressure forces on the two pistons to be unbalanced in such a way that it tends to push the plunger further off center, resulting in an axially unstable arrangement. To solve such a situation, these patents introduce ports on the gas springs. When the piston begins to go off center, an opposing average pressure force which is larger than the destabilizing force coming from the cylinder would be generated resulting in a stable operating center position.

While such an arrangement has proved eminently satisfactory in the two-compressor-cylinder arrangement, axial positioning stability in a single cylinder arrangement is also desired.

In addition, it is desirable to provide for a RPC which is of the single cylinder type but which can operate over a broad range of intake and discharge pressures, such as that which occurs in residential heat pump applications.

DISCLOSURE OF INVENTION

It is a principle object of the invention to provide for a Resonant Piston Compressor which provides for a broad range of suction and discharge pressures and which is advantageously utilized in a single cylinder arrangement.

It is a further object to provide for such an RPC which includes a balancing and stabilizing construction which is relatively small in size and of reduced costs.

It is a further object to provide for such an RPC especially adapted for use in a heat pump application.

The present invention provides for a Resonant Piston Compressor for use in a variety of applications such as, in particular, a heat pump application. The RPC includes a linear reciprocating electric motor drive.

Preferably, electrodynamic motor has a lightweight flat plunger which significantly reduces the amount of resonance spring required. The plunger assembly is formed from alternate layers of magnetic and insulating strips clamped together with suitable tie rods and maintained on respective guide shafts which reciprocate on guide members within the gap between stator members. One end of the motor plunger is coupled to a compression piston and a centering or resonance spring may be provided at the opposite end. In some applications due to the centering effect of the motor resulting from the magnetic driving force, such centering spring may not be necessary.

Positioned about and spaced from the plunger core is a motor stator assembly which is mounted to the housing. The application of current to the stator windings causes a driving force on the plunger core which in turn drives the piston for compression of the working fluid. The piston is ported to maintain centered operation of the piston stroke with the stator assembly.

In a heat pump application, there is no fixed design-point condition since the compressor inlet and discharge pressures change with the change in outdoor temperature. Accordingly, there is significant variation in the gas-spring stiffness of both the compressor and balance chamber which in time cause a significant variation of the resonant tuning of the RPC.

To compensate for a large change in cylinder stiffness, an adjustable cylinder head is provided. Depending on the particular state of affairs, the head will either maintain the cylinder volume at a smaller volume or at an expanded volume depending on the external situation as will be more fully discussed herein.

BRIEF DESCRIPTION OF THE DRAWINGS

The aforenoted objects and advantages and others will be realized by the present invention, the description of which should be taken in conjunction with the drawings wherein.

BEST MODE FOR CARRYING OUT THE INVENTION

Figure 2:
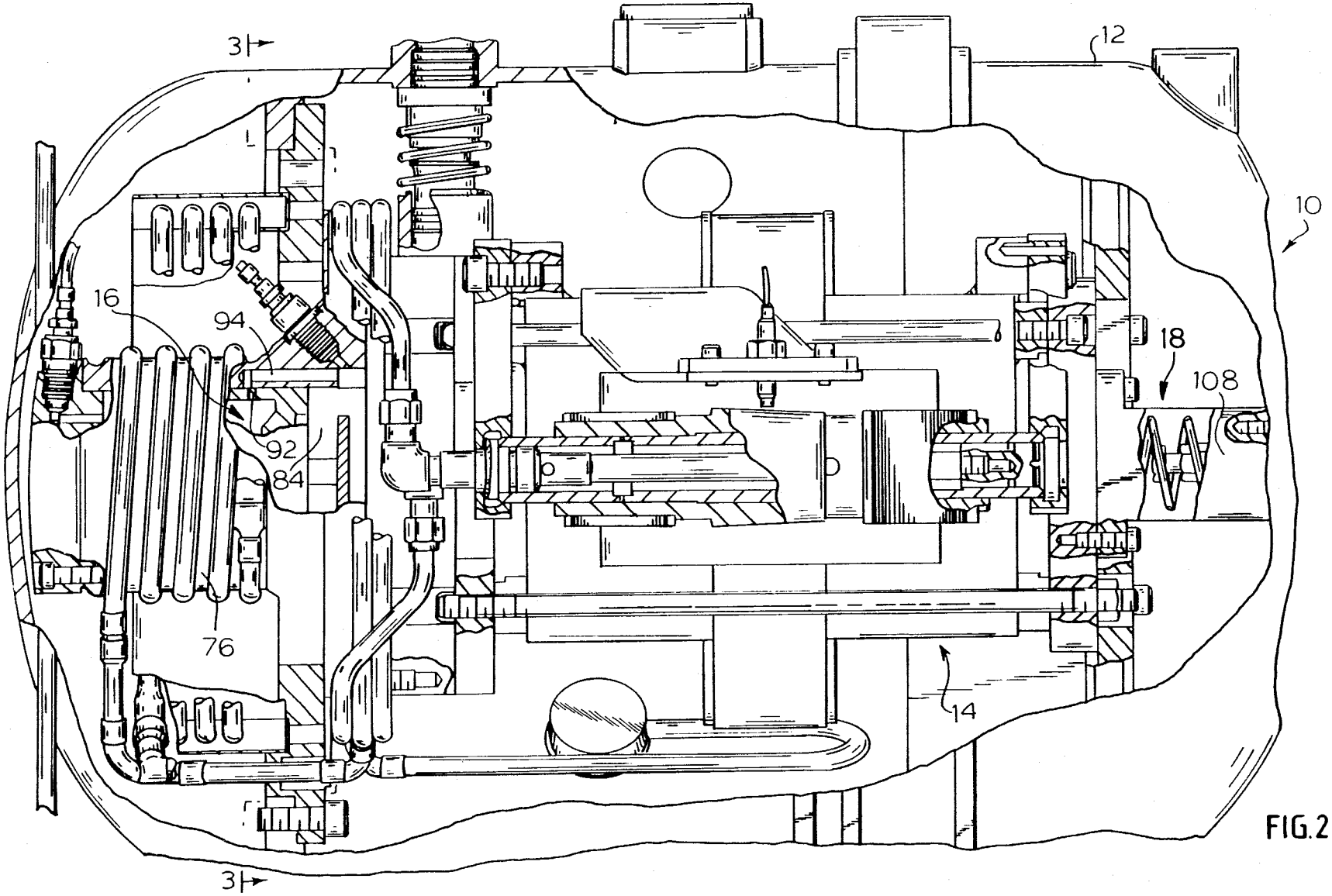
FIG. 2 is a detailed, partial sectional side view of the flat type electrodynamic motor illustrated in association with a single piston arrangement.
Figure 4:
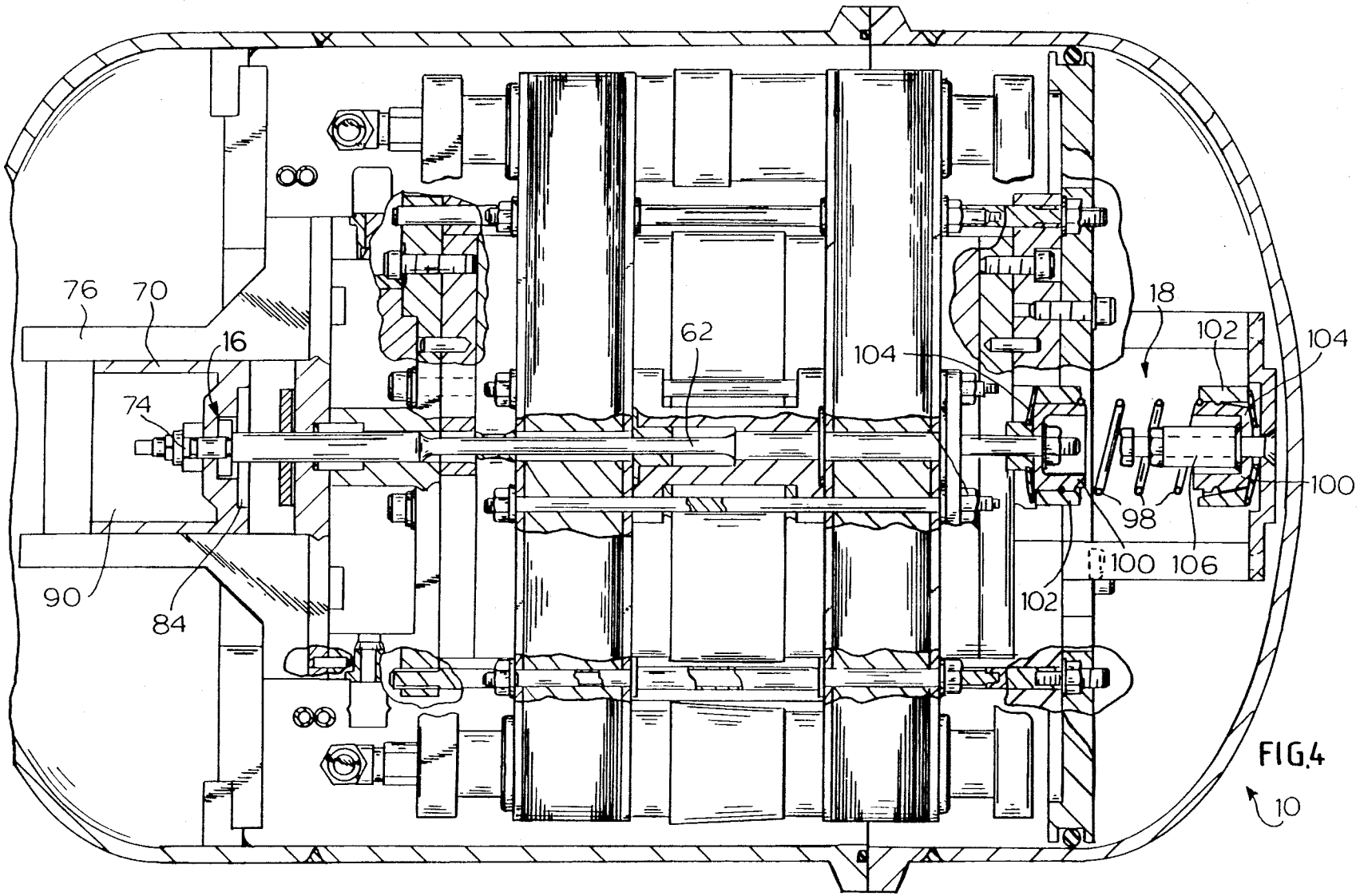
FIG. 4 is a detailed, partial sectional side view taken along line 4—4 of FIG. 3.

With more particular regard to the drawings, there is shown a compressor 10. The compressor 10 includes an outer housing 12 which is cylindrical in shape containing a flat type electrodynamic motor, generally indicated at 14 coupled to a compression piston assembly 16. A centering spring assembly 18, shown more clearly in FIGS. 2 and 4, is provided at the opposite end of the motor. In operation when an alternating current is applied to the motor its magnetic plunger is caused to drive the compression piston in a first direction compressing the working fluid (such as air, helium, etc.). The current then alternates so that the plunger oscillates and returns to its center position due to the reversed driving force by the stator and/or the centering spring assembly 18. The motor operates typically on the order of 60 Hertz continuously compressing the working fluid.

Figure 1:
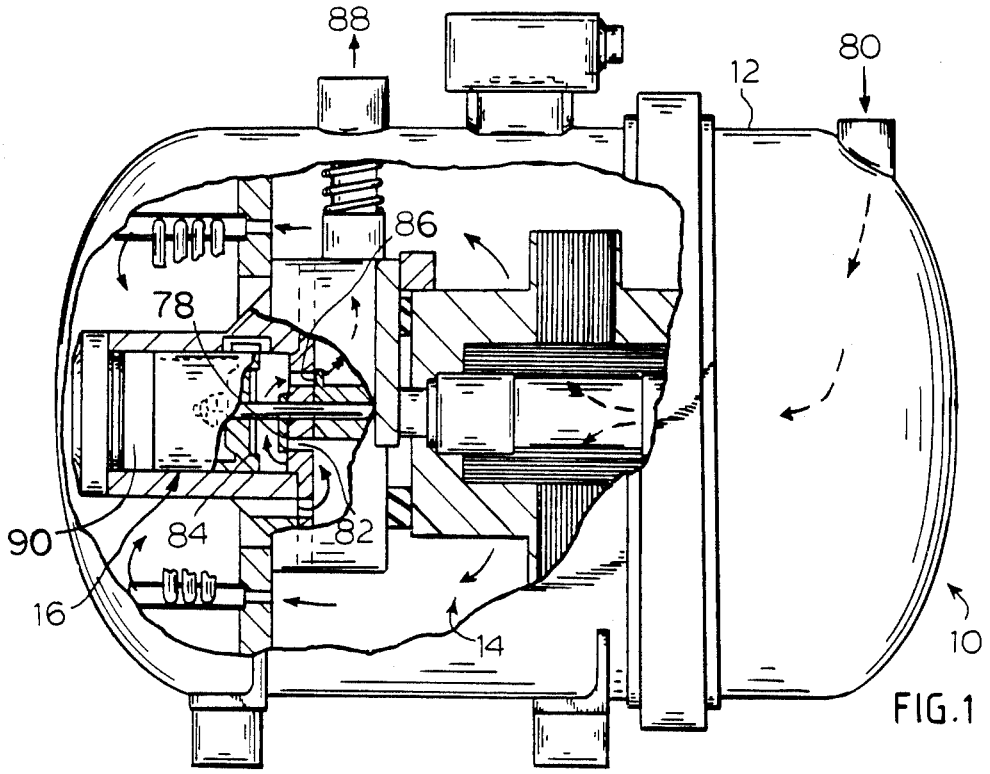
FIG. 1 is a partial sectional side view of a flat type electrodynamic motor illustrated in association with a single piston arrangement.
Figure 3:
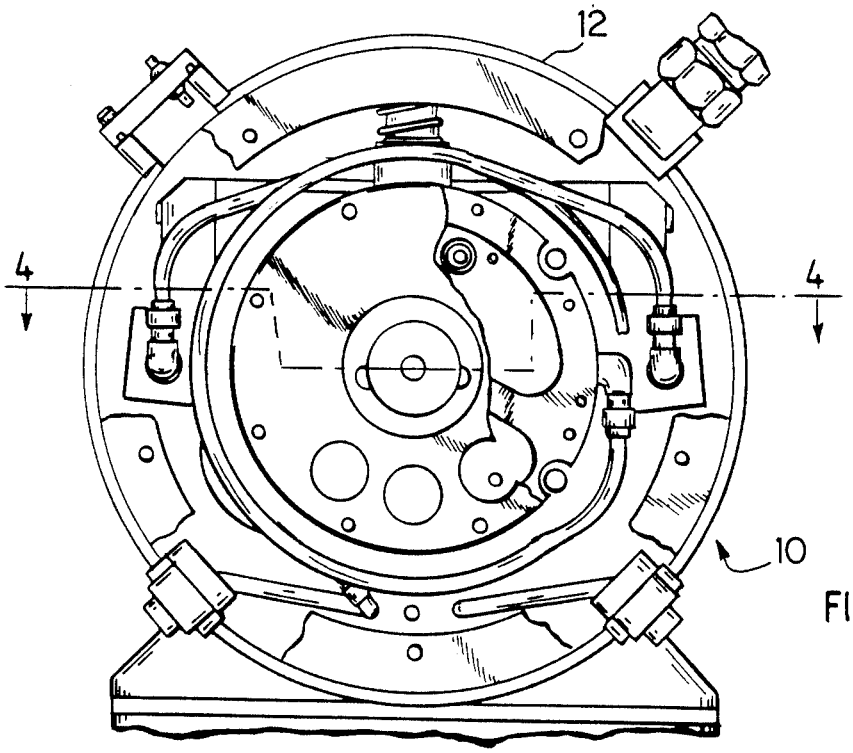
FIG. 3 is a front, partial sectional view taken along line 3—3 of FIG. 2.

As shown more clearly in FIG. 4, piston 64 comprises a hollow cylindrical piston member 70 having a closed end 72 which is mechanically affixed at 74 to one end of rod 62 which in turn is connected to the armature of motor 14. The piston 64 is positioned in a cylindrical cylinder housing 76 which includes suction valve 78 for receiving the suction or working gas. The working gas enters the housing at opening 80 and passes through the housing in the direction shown by the arrows in FIG. 1. The gas enters channel or port 82 and passes through suction valve 78 into compression chamber 84 where it is compressed and exits via discharge valve 86 and outlet 88. As illustrated, the compression stroke is to the right but can be in either direction.

The piston 64 is a double-acting piston which compresses on both sides of its face so that on the opposite side of the compression space there is a closed volume or balance chamber 90. Since in certain applications there may be no counteracting force on the piston such as that usually provided by the spring assembly 18, the piston 64 is ported at 92. A slot or channel 94 is provided in the cylinder wall which communicates with the compression space 84. Each time the piston 64 reciprocates through or near its mid-stroke position the port 92 is communicating with the channel 94 and in turn the compression space 84. The instantaneous pressures in the balance chamber 90 and the compression chamber 84 are not normally balanced at the instant when port 92 is communicating these two chambers with each other. Port 92 and channel 94 serve to provide a means for balancing the pressure forces on each face of the piston when the pressure forces are averaged over a complete reciprocation cycle and, in addition, provides a stabilizing force gradient. This eliminates the need for using mechanical springs for resonance purposes and stabilization. The foregoing porting allows for an equal mean pressure on both sides of the piston (i.e., time averaged) and enables the balancing and stabilizing space 90 to develop a stabilizing gradient sufficient to keep the piston operating at a reasonably fixed mid-stroke position. Such a space also provides for dynamic stiffness which serves to resonantly tune the device which is adjustable by adjusting the balancing chamber volume to achieve the desired dynamic tuning stiffness.

As aforenoted, the centering effect of the motor tends to cause the plunger assembly to center itself. If desired, however, depending upon the particular application, a spring assembly 18 may be utilized for centering and resonance purposes where applicable. In this regard and as shown most clearly in FIG. 4, the plunger assembly of motor 14 is mechanically affixed to the spring assembly 18. The spring assembly 18 is intended to utilize a helical high strength steel coil spring 98.

It was found that when a helical spring is subject to high frequency oscillating displacement (i.e., 60 Hertz), early fatigue failure is a problem. If the dynamic deflection range is small (of the order ½ inch or less), it is generally possible to use a conventional helical compression spring wherein the spring is preloaded between two plates. This results in the situation that the spring will always be in a state of compression as the relative displacements of the end plates subject the spring to the high frequency oscillatory deflection. Preloaded compression spring arrangements are shown, for example, in U.S. Pat. Nos. 3,814,650 and 3,788,778. In preloaded compression spring arrangements there is no means required for mechanically gripping or clamping the ends of the spring coil. However, such an arrangement cannot, by its nature, transmit tensile loading to a helical spring. Thus, if it is desired to subject a helical spring to tensile displacements, the preloaded compression spring arrangement is not sufficient.

As noted, helical compression springs should be limited to dynamic deflection ranges of ½ inch or less (for high strength steel springs) if very long operating life is required at 60 Hertz. For any given spring material and operating frequency the dynamic deflection range will vary. However, if a helical spring is used as a tension-compression spring, such that one-half of the dynamic deflection range is achieved by compressive deflection and the other half by tensile deflection, the dynamic deflection range of the spring can be extended to approximately 1 inch. To achieve this extended deflection range, means must be provided for gripping the ends of the spring coil in such a way that (1) tensile deflections can be imparted to the spring, and (2) stress concentration effects arising from the gripping means are small.

The gripping arrangement for the helical spring assembly 18 (FIG. 4) attempts to simulate to a certain degree the method of stress transition which exits in a compression-only spring. With this gripping method, the spring can be operated as a tension-compression spring.

In this arrangement, the helical spring 98 is "threaded" onto a suitably machined mandrel block 100. The outside diameter of the spring is ground with a taper which matches the internal diameter taper of a clamping collar 102. The collar 102 is axially loaded against the ground outer diameter of the spring 98 by a suitable loading means such as, for example, a Belleville washer 104.

With this arrangement, there will be a differential strain between the surface of the stressed spring 98 and the essentially unstressed surface of the mandrel 100 against which the spring is seated. This differential strain is greatest at the point where the coil enters the mandrel thread and may result in surface fretting (wear) of the spring 98.

To alleviate the fretting wear problem, the spring 98 and/or the mandrel block 100 should be dip-coated in epoxy (or other low modulus material) to form a thin, low modulus coating which can absorb the differential strains.

The opposite end of the spring is similarly affixed with the exception that the mandrel, collar and washer are held in place by way of a mounting bolt 106 axially centered with respect to the spring 98 mounting it to perhaps a spring assembly housing 108.

While the foregoing arrangement is eminently satisfactory in certain applications, it is desired to provide an RPC which operates over a broad range of suction and discharge pressures such as that which occurs in a residential heat pump.

The advantage of the RPC in such an application is that variable capacity heat pump operation can be achieved by modulating the RPC's piston stroke. In conventional heat pumps, variable capacity operation is generally achieved by modulating speed of the compressor by varying the electrical frequency supplied to the compressor motor. However, the cost of the solid-state electronic components required to achieve a variable frequency motor drive would be appreciably higher than the cost of the components needed for a fixed-frequency variable current drive for a modulating RPC.

Unfortunately, the heat pump application does not have a fixed design-point condition. The compressor inlet and discharge pressures change with changes in outdoor temperature. For example, at an outdoor temperature of 95° F., the compressor inlet and discharge pressures for R-22 refrigerant will typically be 90 and 300 psia, while on a 15° F. day the inlet and discharge pressures will typically drop to 37 and 200 psia, respectively. As a result of this variation in pressures, there is a significant variation in the "gas-spring stiffness" of both the compressor and the balance chamber with outdoor temperature. This in turn causes a significant variation in resonant tuning of the RPC, to the point where satisfactory operation of the RPC is not possible at one or the other outdoor temperature extreme.

For example, the case of a 2½ ton rated compressor. The following table shows the variation in compressor and balance cylinder stiffness for outdoor temperatures of 95° F. and 12° F.

| Outdoor Temperature (°F.) | Stiffness (lbf/in) Compressor Cylinder | Balance Cylinder | Total Stiffness |
|---|---|---|---|
| 95 | 1735 | 228 | 1963 |
| 12 | 1019 | 126 | 1145 |

There is roughly a 40 percent reduction in total stiffness at the 12° F. outdoor temperature condition compared to the 95° F. condition. This is too great a reduction for a fixed frequency, resonantly operating RPC.

More particularly, for a plunger of 6 pounds, and a natural frequency of 60 Hertz, required the gas-spring stiffness of the unit is ~2000 lbf/in. During air-conditioning operation on a 95° F. day, ~90 percent of this required stiffness is supplied by the compression chamber. The remaining 10 percent must be supplied by the balance chamber. However, during heating operation on a 12° F. day, the compression chamber will provide only 60 percent of the required stiffness due to the reduced pressure level of the R-22 refrigerant cycle. The remaining 40 percent must be supplied by the balance chamber. However, for the same reason that stiffness of the compression chamber is reduced on a 12° F. day, also so will the stiffness of the balance chamber be reduced unless some other means is available to counter this reduction.

Figure 5:
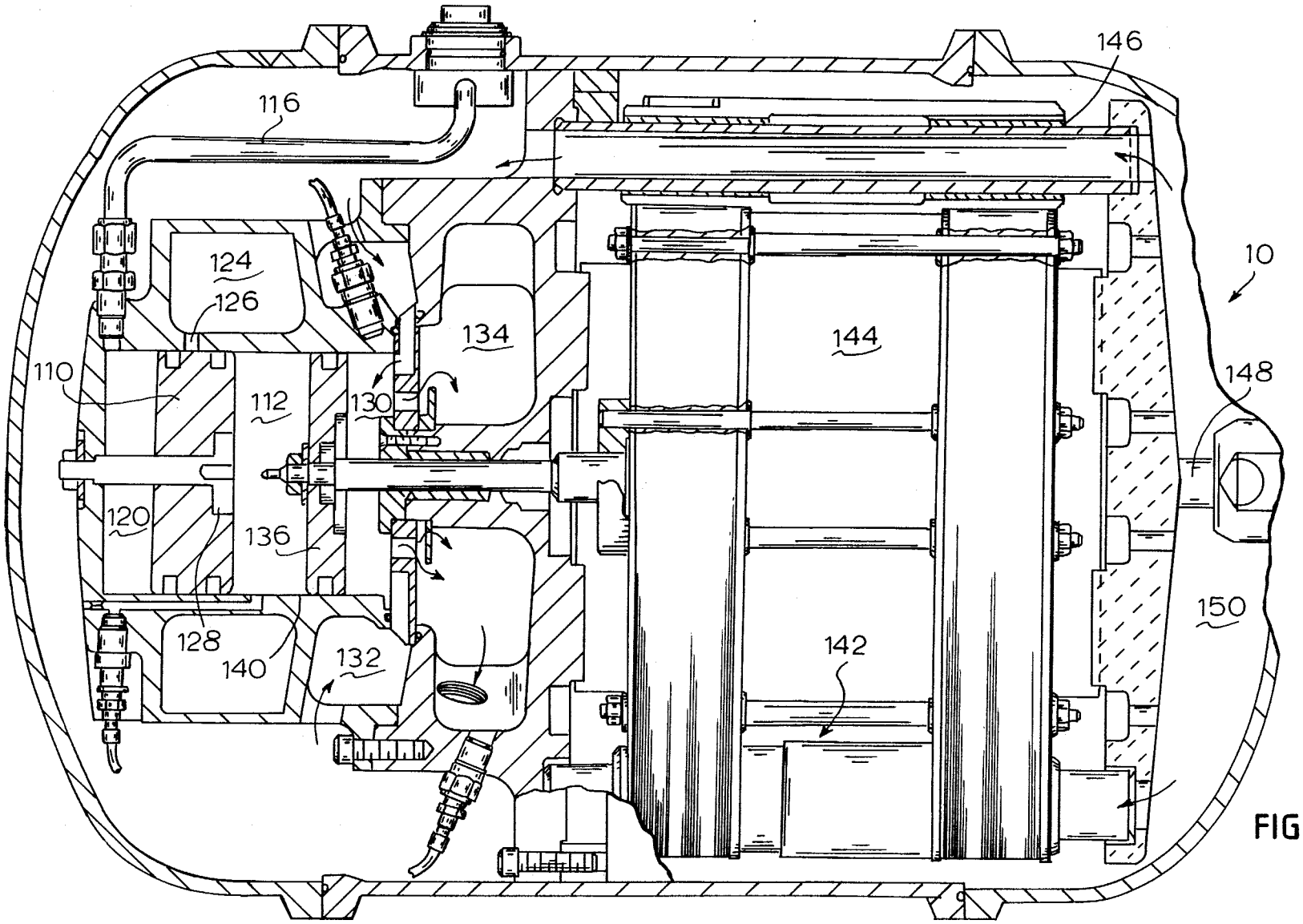
FIG. 5 is a schematic view of a RPC balance cylinder in a heat pump situation in the heating mode, incorporating the teachings of the present invention.

As shown in FIG. 5, there is provided in the RPC a modified balance chamber to counter the effect of reduced stiffness during heating operation. This feature is by way of a movable cylinder head 110 which will reduce the volume of the balance chamber 112 by a factor of approximately seven during heating mode operation. With the reduced balance chamber 112 volume, stiffness of the chamber 112 will indeed be increased to the point where it can provide 40 percent of the total required stiffness.

The movable head 110 has only two operating positions, either all the way left (maximum volume) or all the way right (minimum volume). During air-conditioning operation, the head 110 will be to the left, during heating operation, to the right. Movement of the head 110 is actuated by exposing the left face of the head 110 to either compressor suction or discharge pressure. The actual pressure condition is determined by the position of the heat pump system's reversing valve 114.

Figure 6:
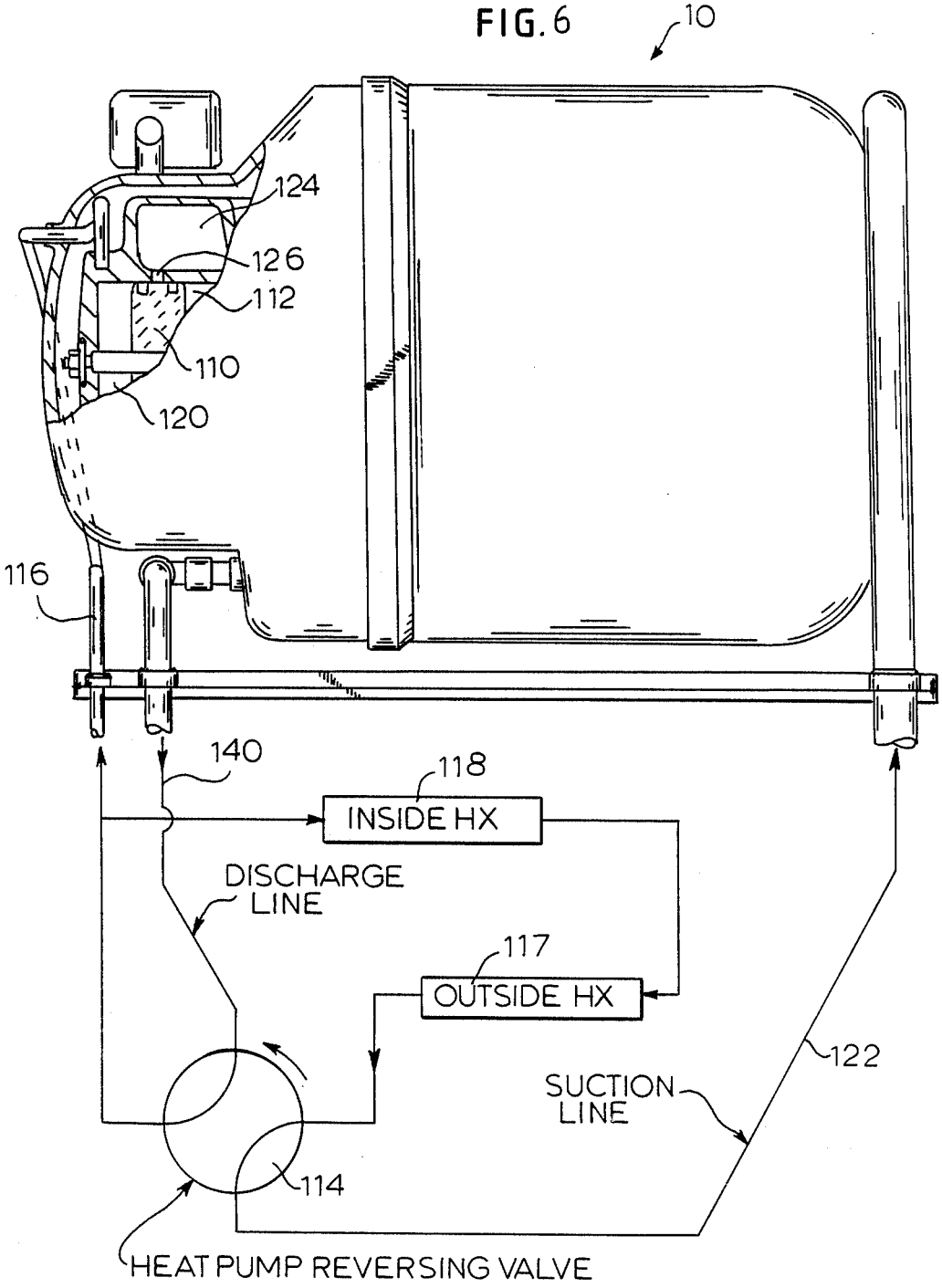
FIG. 6 is a detailed sectional view of a RPC in a heat pump situation in the heating mode having the pressure actuated movable head, in accordance with the teachings of the present invention.

FIG. 6 shows a schematic diagram of the head actuating arrangement. This consists of a pressure tap line 116 running from one side of the indoor heat exchanger ($H_x$) 118 to the left side chamber 120 of head 110.

During heating mode operation, the pressure tap line 116 will provide compressor discharge pressure to the head 110. Since balance chamber pressure will always be less than discharge pressure, there will always be a differential pressure force across the head 110 holding it in its right-most position.

During cooling mode operation, pressure tap line 116 will provide compressor suction pressure to the left side chamber 120 of head 110. Since balance chamber 112 pressure will at all times be greater than suction pressure via suction line 122, there will always be a differential pressure force across the head 110 holding it in its left-most position.

Figure 7:
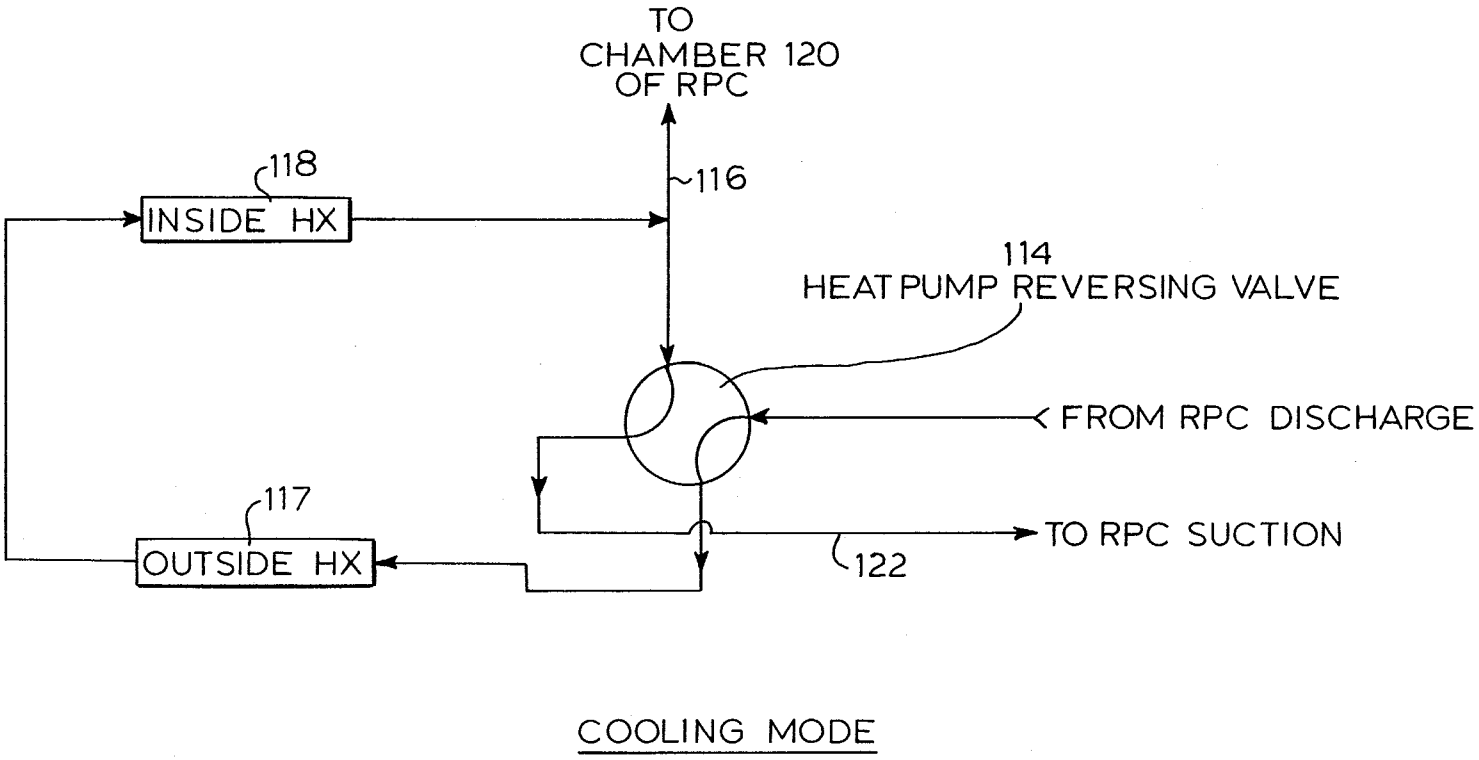
FIG. 7 is a schematic view of a RPC balance cylinder in a heat pump situation in the air conditioning mode, incorporating the teachings of the present invention.

Further in this regard, and with reference to FIGS. 5, 6, and 7, when the heat pump system's control thermostat is set for air-conditioning operation, the heat pump reversing valve 114 will be as shown in FIG. 7. The left side chamber 120 or left side of face of the movable cylinder head 110 will be exposed to the pressure at the discharge end of the indoor heat exchanger 118, which is compressor suction pressure. During air-conditioning operation, the indoor heat exchanger 118 would act as an evaporator coil. The outdoor heat exchanger is designated 117. If, for example, the outdoor temperature is 95° F., the pressure acting on the left-hand face will be about 88 psia and will thus the movable head 110 will remain fixed in its left-most position during heat pump operation on a 95° F. day.

Although the above discussion is with reference to a 95° F. day, the same result—namely, that the movable cylinder head will be held in its left-most position—will in fact be realized throughout the air-conditioning range of heat pump operation.

With reference to FIG. 5, when the movable cylinder head 110 is in its left-most position, the total balance cylinder volume 112 now includes the extended balance cylinder volume 124. This extended volume is coupled to the central balance cylinder volume 112 by means of ports 126 in the cylinder wall. Since the total balance cylinder volume (112 plus 124)is quite large during air-conditioning operation (i.e., when the movable cylinder head is in its left-most position), the stiffness of the balance chamber will be minimized.

Alternatively, in the case when outdoor temperature is 12° F., the heat pump thermostat control would be set to the heating position and the heat pump reversing valve 114 would be in its heating mode position as shown in FIG. 6. In this position, the left-hand face of the movable cylinder head 110 will be exposed to the pressure at the inlet end of the indoor heat exchanger 118, which is compressor discharge pressure. During heating operation, the indoor heat exchanger 118 would be a condensor.

Compressor discharge pressure in discharge line 140, during heating mode operation will typically be in the range of 180 to 210 psia, depending on the particular combination of outdoor temperature and heat load condition. The pressure on the right-hand face of the movable cylinder head 110 (i.e., the balance cylinder 112 pressure) will always be less than the discharge pressure. The net differential pressure force acting on the cylinder head will cause the head 110 to move to its right-most position against a stop ring 128. In this right-most position, the movable head 110 will block off the cylinder wall ports 126 which connect to the extended cylinder volume 124. The total volume of the balance chamber during heating operation will thus be about 15 percent of its volume during air-conditioning operation. This smaller volume during heating mode will cause the balance chamber to operate with greatly increased stiffness. The advantage of this system can be seen as follows. Compare the total stiffness conditions at 95° F. and 12° F. outdoor temperature previously given to that now with the much smaller balance cylinder volume.

| Outdoor Temperature (°F.) | Stiffness (lb/in) Compressor Cylinder | Balance Cylinder | Total Stiffness |
|---|---|---|---|
| 95 | 1735 | 228 | 1963 |
| 12 | 1019 | 815 | 1834 |

With the movable head 110, the total stiffness at 12° F. drops only 7 percent from that which existed at 95° F. The resonant tuning of the RPC is thus only slightly changed, and operation at both temperature extremes is possible.

It should be understood that while the foregoing example utilized a movable head in a heat pump arrangement, the present invention should not be limited thereby since the head movement can be actuated by any source of sufficient pressure (or vacuum). One such source is always the compressor itself, regardless of what gas is being compressed or what application is being served.

For purposes of completing the description of FIG. 5, there is shown a compression chamber 130 coupled to suction plenum 132 and discharge plenum 134. Piston 136, which reciprocates in the cylinder 140, is coupled to the flat-type motor plunger generally designated 142 of the type described previously which reciprocates within motor stators 144 and is mounted on bearing sleeves 146. Cylinder 140 is divided by piston 136 into two spaces 112 and 130. A suction line 148 is provided along with internal casing volume 150 which communicates directly with suction plenum 132.

Although only certain specific embodiments of the invention have been described in detail herein with reference where suitable to the accompanying drawing, it is to be understood that the invention is not limited to those specific embodiments and that various changes and modifications will occur to and be made by those skilled in the art. The appended claims, therefore, are intended to cover all such changes and modifications as fall within the true spirit and scope of the invention.

What is claimed is:

1. A resonant piston compressor comprising:

cylinder means;

piston means for reciprocal movement in said cylinder means;

cylinder head means positioned in said cylinder means and defining a cylinder space;

said piston means in association with said cylinder means defining a compressor space on one side of said piston means and in further association with said cylinder head means to define a balance chamber on the other side of said piston means;

an extended balance chamber volume separate from said balance chamber;

said cylinder head means being adjustable so as to vary the volume of the balance chamber between a first position at which said extended balance chamber volume is coupled to the balance chamber and a second position where said extended balance chamber is decoupled from said balance chamber, which in turn varies the stiffness exerted on the piston means by the balance chamber during said piston means reciprocal movement;

motor means for driving said piston means in said reciprocal movement; and adjusting means for adjusting said cylinder head means so as to adjust the volume of the balance chamber.

2. The invention in accordance with claim 1, wherein said adjusting means include valve means for varying the differential pressure across the cylinder head means so as to move it from the first to the second position and vice versa.

3. The invention in accordance with claim 2, wherein said compressor is used in a heat pump and said valve means comprises a heat pump reversing valve which adjust said cylinder head means so as to be in the first position for air cooling operation and the second position for air heating operation.

4. The invention in accordance with claim 3, wherein said motor means comprises a linear electrodynamic motor.

5. The invention in accordance with claim 1, wherein said motor means comprises a linear electrodynamic motor.

* * * * *